US005241460A

United States Patent [19]

Schonbek

[11] Patent Number: 5,241,460

[45] Date of Patent: Aug. 31, 1993

[54] STRETCHABLE CHANDELIER ORNAMENT STRING

[75] Inventor: Arnold Schonbek, Plattsburgh, N.Y.

[73] Assignee: Schonbek Worldwide Lighting Inc., Plattsburgh, N.Y.

[21] Appl. No.: 964,410

[22] Filed: Oct. 21, 1992

[51] Int. Cl.[5] ..... F21V 5/06; F21V 17/00

[52] U.S. Cl. ..... 362/405; 362/339; 362/457; 362/806

[58] Field of Search ..... 362/147, 306, 337, 338, 362/405, 433, 434, 440, 444, 452, 457, 806, 332

[56] References Cited

U.S. PATENT DOCUMENTS

| | | | |
|---|---|---|---|
| 401,934 | 4/1889 | D'Humy | 362/433 |
| 528,241 | 10/1894 | Vedovely | 362/332 |
| 1,014,460 | 1/1912 | Giroux | 362/433 |
| 3,820,201 | 6/1974 | Burckhardt | 362/457 |
| 5,144,541 | 9/1992 | Schonbek | 362/405 |

*Primary Examiner*—Richard R. Cole

*Attorney, Agent, or Firm*—Wolf, Greenfield & Sacks

[57] ABSTRACT

A chandelier having tensioned strings of ornaments is provided. The chandelier includes a frame having first and second attachment locations and at least one string of ornaments extending between the first and second attachment locations and tensioned in a predetermined pattern by corresponding tensioning structures such as springs attached to the strings of ornaments.

17 Claims, 13 Drawing Sheets

STRETCHABLE CHANDELIER ORNAMENT STRING

BACKGROUND OF THE INVENTION

1. Field of the Invention

This invention relates to chandeliers and more particularly to an improved structure for a chandelier ornament chain or string.

2. Background Description

It is often desirable in the construction of chandeliers to position strings or chains of ornaments between two attachment locations on the chandelier frame. By strings or chains, it is meant a group of ornaments, often cut crystal or glass, linked by metallic or other attachment members so as to form a string of attached ornaments. A chandelier having a multiplicity of ornament strings is shown in FIG. 1. The strings 30 of ornaments 32 in this example form a substantially conical basket structure 34 that surrounds a central support and light element 36. The light element 36 is attached at one end to an upper plate like frame member 38 from which the strings 30 hang. The light element 36 supports a lower frame member 40 at its opposite end. The strings 30 converge at the lower frame member 40.

In the FIG. 1 example, the lower frame member 40 provides some tensioning to the strings 30 by virtue of its fixed spacing from the upper frame member. However, since the strings 30 are not particularly rigid due to flexure between ornaments 32 and links 42, the strings 30 and lower frame member 40 can tend to sway and twist relative to the frame. This causes misalignment between the various strings 30 and destruction of the intended, overall pattern created by the strings, in this case basket structure 34. Such misalignment is optically undesirable and detracts from the attractiveness of the chandelier design.

The optical disadvantages caused by strings that become misaligned are also prevalent in certain types of wall mounted light fixtures. FIG. 2 shows a light fixture 44 in which a wall mounted light element 46 is surrounded by a semi circle or cylinder 48 of hanging ornament strings 50. Such strings 50, even when tensioned between opposing upper and lower frame members 52 and 54 tend to vary in length. Thus, some of the strings 50 positioned between upper and lower frame members 52 and 54 are looser than others. These slack strings tend to sway and become misaligned relative to other strings detracting from the desired optical effect.

In the past, in order to insure that the strings of a chandelier would remain aligned relative to each other, it was necessary to carefully regulate the length of each string so to ensure that all strings were of substantially equal length. All the strings then would be tensioned between respective attachment locations on opposing frame members. However, even in chandeliers having substantially equal length strings, minor variations in string length made it difficult to maintain even tension on all strings. Some strings would still remain loose while others would be stretched almost to breaking. Similarly, over time, tensioned strings tend to stretch on their own through deformation causing slack to develop. Hence, tensioning many or all strings at once by simply positioning one frame member at a predetermined distance from another does not always ensure the desired overall result. It is possible to construct devices whereby strings can be adjusted individually. It, however, can prove slow and painstaking to tension each string independently by, for example, individual turnbuckles or other tensioning (length reducing) devices attached to each string.

The tensioning of strings by reducing the length between opposing attachment locations, either individually or in groups of strings, also tends to complicate the removal and reattachment of strings. This complication slows maintenance such as cleaning and light bulb replacement.

Finally, it is sometimes desirable to form certain geometrical shapes using ornamental strings as the surface of the shape such as a cone, disk or cylinder. For example, the fixture of FIG. 2 essentially defines the shape of a half or semi cylinder. Since the strings 50 are positioned substantially vertically along the lines of force due to gravity, they naturally tend to hang substantially straight between upper and lower frame members 52 and 54. However, strings 50 that extend substantially transversely to the line of gravity or diagonally across the line of gravity tend to arc substantially absent the application of significant tension to them. As noted above, providing such significant tension to a plurality of strings in a frame is difficult and the tension upon each string can vary greatly within one framework. Thus, some strings may arc significantly while others remain substantially straight. Note that by substantially straight it is meant that a viewer perceives the string as defining a straight line. Gravity naturally causes any flexible object suspended across its lines of force to arc by, at least, an imperceptible amount. Since a chandelier is an ornamental body, the perception of straight ornament lines proves the important consideration. Thus, as long as the tension on the strings is sufficient to form the strings into perceptibly straight lines, such strings shall be deemed to be "substantially straight".

In view of the above described disadvantages of the prior art, it is an object of this invention to provide a structure for tensioning ornament chains or strings between attachment locations on a chandelier frame that applies tension to each string independent of minor variations in string length. It is a further object of this invention to provide a structure for tensioning chandelier ornament strings that allows the formation of a large number of geometrical shapes using substantially straight tensioned chandelier strings to define the surfaces of the shapes. A further object of this invention is to provide a tensioning structure that allows for easy attachment and removal of strings from the chandelier frame.

SUMMARY OF THE INVENTION

The disadvantages of the prior art are overcome according to this invention by providing a chandelier that is adapted to carry a plurality of constantly tensioned strings of ornaments between respective first and second attachment locations on the frame. Each of the plurality of ornaments is tensioned by means of a tensioning structure comprising a spring. The spring comprises an elastically deformable element of any suitable spring material. A tensioned coil spring or a leaf spring provide two suitable spring structures according to this invention. Such a spring tensioning structure is positionable between an end of the string and one of the attachment locations or at another point along the string.

Additional or variable tensioning can be provided according to this invention by incorporating moving frame members that allow opposing attachment locations for one or more of the strings to be brought closer to or further from each other. The moving frame member can include an adjustment screw for locking it in a predetermined position to maintain a predetermined level of tension in strings positioned thereon.

BRIEF DESCRIPTION OF THE DRAWINGS

The foregoing and other objects and advantages of the invention will become more clear with reference to the following detailed description of the preferred embodiments and brief description of the drawings in which.

DETAILED DESCRIPTION OF THE PREFERRED EMBODIMENTS

Figure 1:
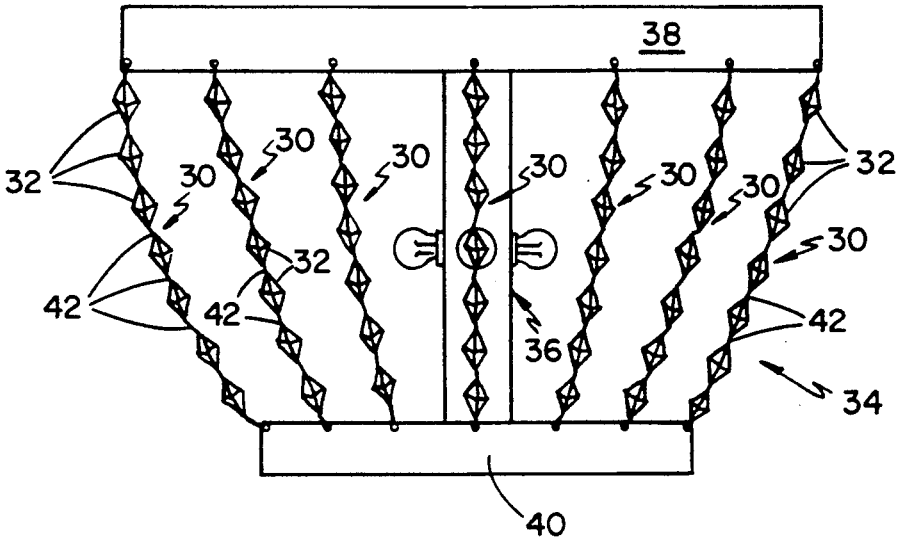
FIG. 1 (PRIOR ART)
FIG. 1 is a side view of a chandelier having strings of ornaments defining a substantially conical basket according to the prior art.
Figure 2:
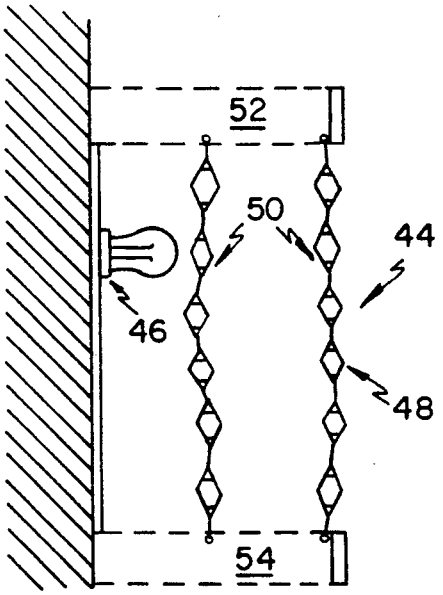
FIG. 2 (PRIOR ART)
FIG. 2 is a side view of a semi cylindrical basket formed of strings of ornaments for surrounding a wall mounted light element.
Figure 3:
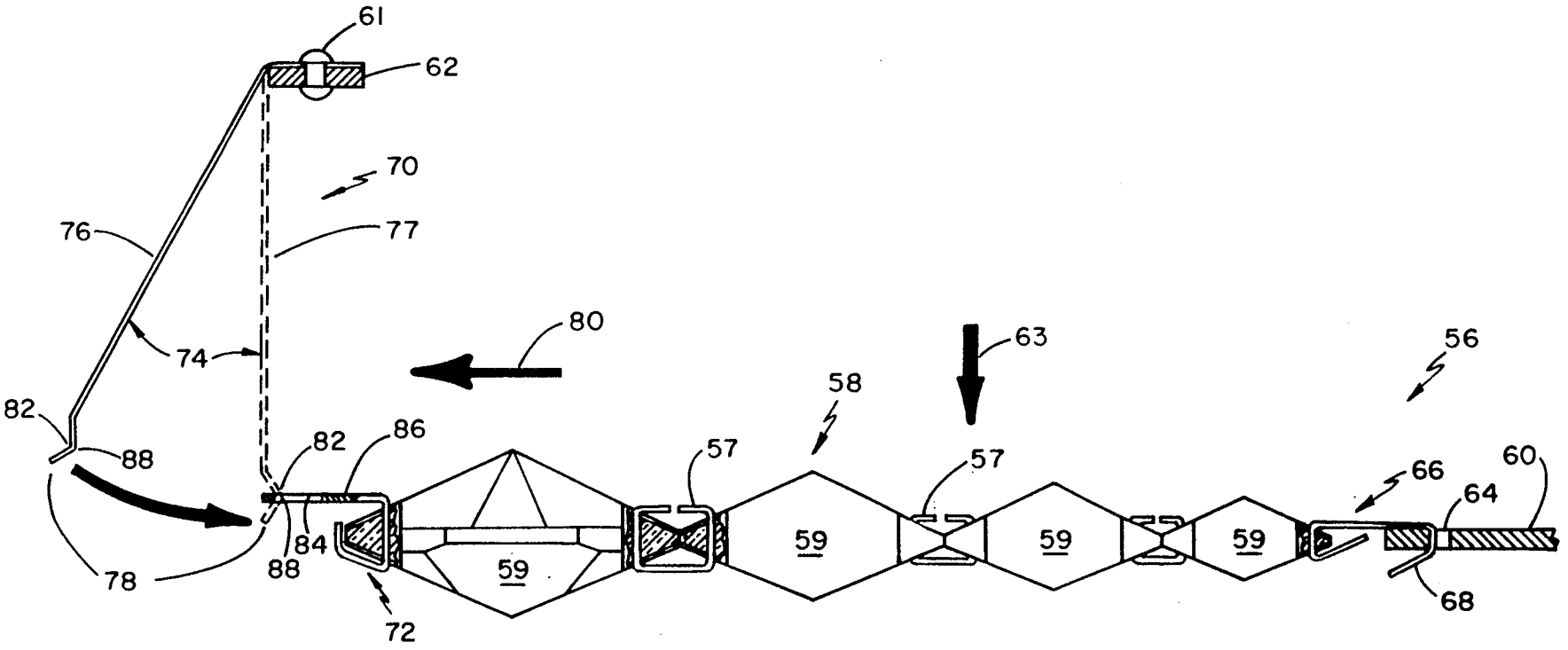
FIG. 3 is a partial cross sectional side view of a chandelier frame having an ornament string tensioned by a spring structure according to one embodiment of this invention.
Figure 4:
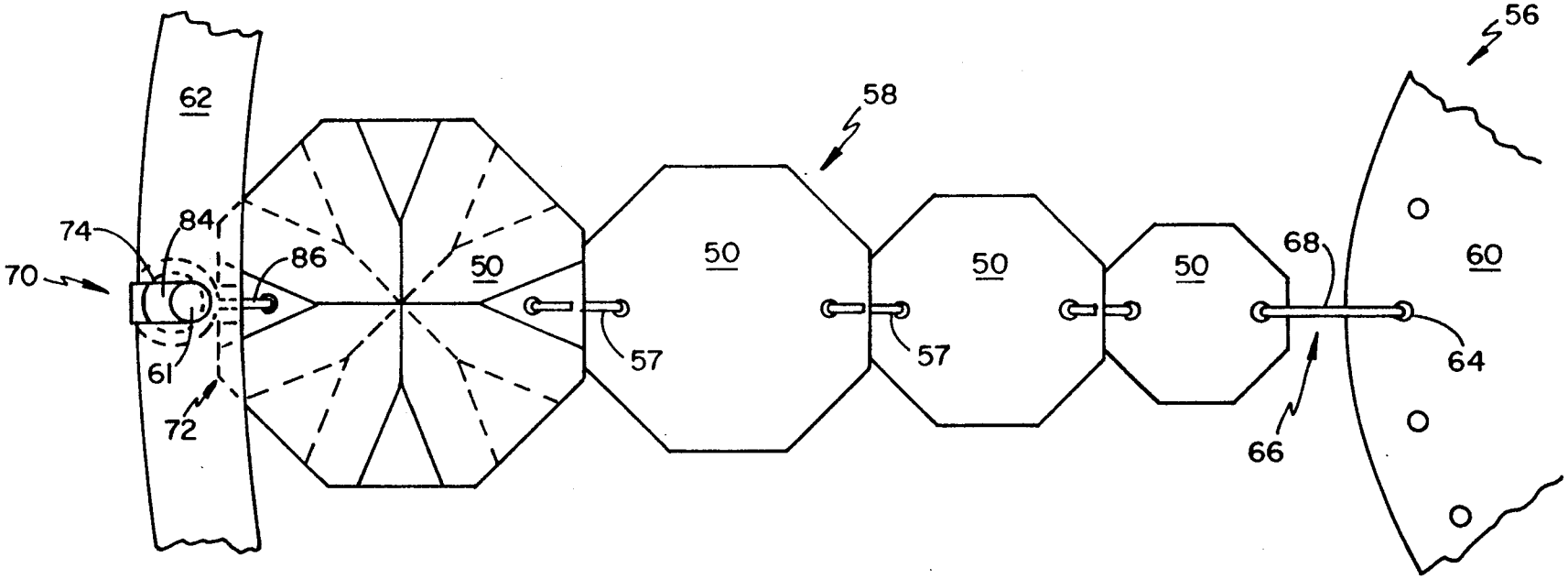
FIG. 4 is a partial top view of the chandelier frame of FIG. 3.

FIGS. 3 and 4 illustrate part of a chandelier having a frame 56 constructed of central and outer frame members 60 and 62 in which a substantially flexible chain or string 58 of ornaments 59 having links 57 therebetween is suspended between opposing attachment locations on each of the central and outer frame members 60 and 62. The string 58 in this example is substantially transverse to the line of force of gravity symbolized by the arrow 63 (FIG. 3). By "attachment locations", it is meant, positions on chandelier frame members upon which each of opposing free ends of strings are connected. Traditionally holes or slots have served as typical attachment locations. An inner end 66 of the string 58 is attached to a hole 64 in a central frame member 60 using a substantially rigid hook 68. The string 58 is tensioned by means of a tensioning structure 70 that engages the opposing outer end 72 of the string proximate the outer frame member 62. The tensioning structure 70 in this embodiment comprises a leaf spring 74 that extends below the frame member 62 to form a lever arm. The spring 74, in a resting position 76, has a string carrying free end 78 that is spaced from the outer end 72 of the string 58. As such, by rotating the leaf spring 74 toward the end 72 of the string 58 into a string mounting position 77 (shown in phantom), force is utilized that is stored in the spring 74 as tension directed in an opposite direction as symbolized by the arrow 80. The tensioning force is sufficient to tension the string 58 into a substantially straight orientation despite the force of gravity (arrow 63).

The free end 78 of the leaf spring 74 fits through a hole 84 in an end hook 86 of the string and the end hook in this embodiment mates with a detent 82 in the leaf spring to fix the relative position of the leaf spring and end hook. As long as tension is maintained by the spring 74, the detent 82 serves to retain the end hook 86 within the apex 88 of the detent 82.

The detent structure allows for easy attachment and removal of strings 58 from the frame 56. Additional force to the leaf spring in a direction opposite the arrow 80 must be exerted so that the hole 84 of the end hook 86 can pass freely out of the apex 88 and over the furthest end 90 of the detent 82. The string 58 is then free to drop away from the spring 74.

The advantage of a spring as a tensioning structure is that it provides predetermined tension to the string regardless of minor variations in ornament string length. Any minor variations in string length simply results in slight variations in the location of one spring end relative to the opposing frame mounted spring end. The tension imparted by the spring on the string remains relatively constant throughout a predetermined range of spring stretch or deformation. In other words, even if one spring is deformed a centimeter more than another, a one centimeter greater dislocation of the spring will not substantially vary the tension imparted by that spring or the orientation of the string line. Hence, all springs impart substantially equal tension on their respective strings regardless of minor length variations. This tension can be adjusted so that all strings have substantially straight orientation between attachment locations on the frame.

Thus, tensioning structures according to this embodiment serve to prevent sway of the strings between their attachment locations. Furthermore, by tensioning the strings using springs, the links between ornaments become fully extended, thus further preventing twisting of ornaments relative to each other and relative to the attachment locations. The twisting is particularly reduced for embodiments in which links pass transversely through the ends of the ornaments such as the links 57 shown, for example, in FIGS. 3 and 4.

In this embodiment, as well as other embodiments described herein, it is equally possible to locate the tensioning structure (e.g. the spring) proximate either of opposing attachment locations and, as will be detailed further below, remote from the attachment locations. The positioning of the tensioning structure is influenced largely by chandelier construction and maintenance considerations. For example, in certain frame configurations, it may be easier to access and remove strings from the center of the frame rather than from an outer frame member.

Figure 5:
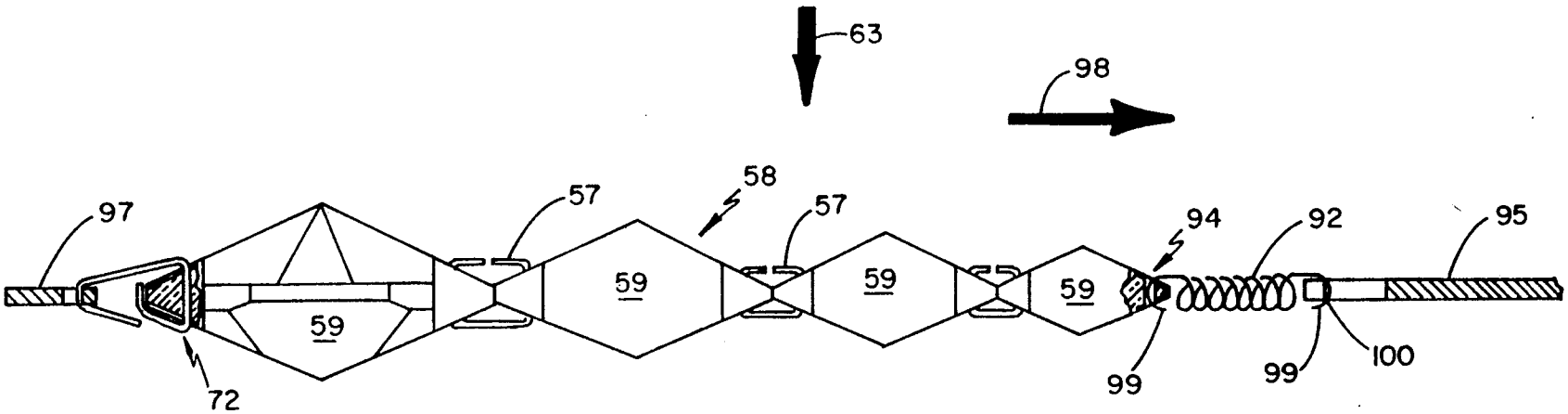
FIG. 5 is a partial cross-sectional side view of a chandelier frame having a string tensioned by a spring structure according to an alternative embodiment of this invention.
Figure 6:
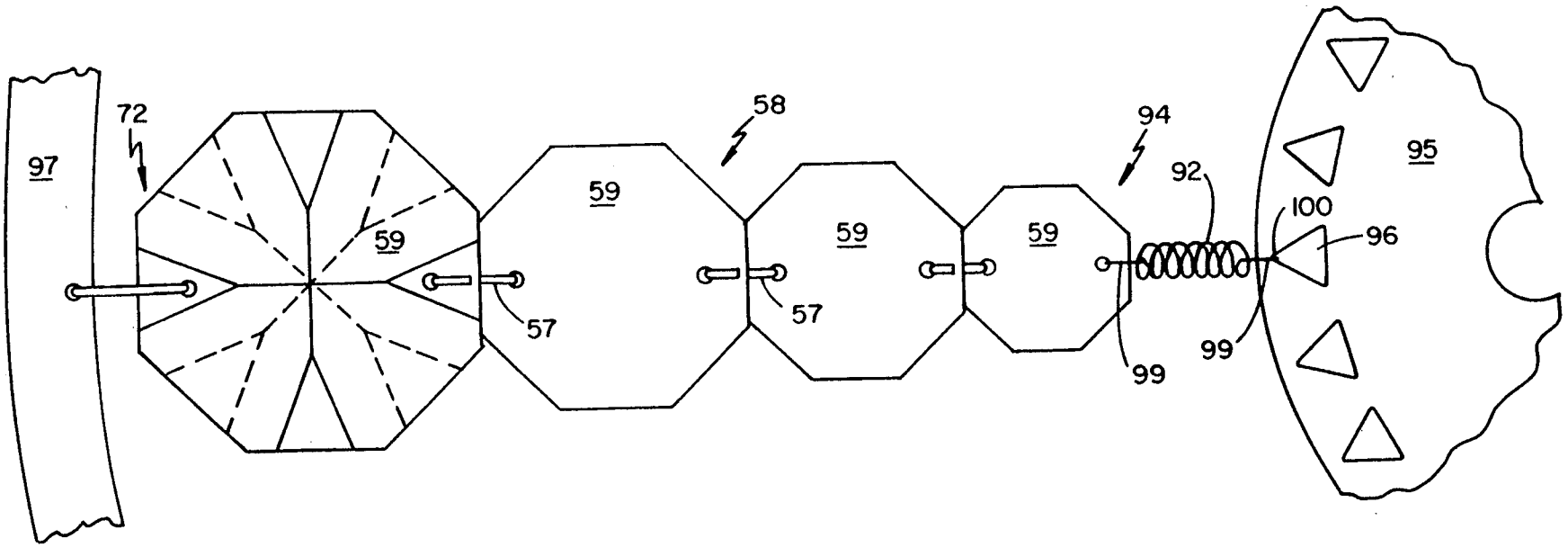
FIG. 6 is a partial top view of the chandelier frame of FIG. 5.

The leaf spring tensioning structure of the embodiment of FIGS. 3–4 can prove highly desirable for certain applications. The detent 82 leaf spring 74 provides an integral hook for attachment to the string end hook 86 that enables quick attachment and removal of strings. An alternative tensioning structure embodiment is shown in FIGS. 5 and 6. In this example, a coil spring 92 is positioned between an inner end 94 of the ornament string 58 and the central frame member 95. The outer end 72 of string 58 is attached to outer frame member 97. In a resting state (not shown), the coil spring 92 is shorter than the distance between the end 94 of the string 58 and the attachment location (triangular hole 96) of the frame member 95. Thus, in order to attach the spring 92 between the frame member 95 and string end 94, it must be stretched by applying force to it. The applied force is stored as tension acting along the direction of the arrow 98 causing the string 58 to assume a substantially straight, tensioned, configuration.

The attachment locations according to this embodiment can comprise conventional round or square holes having a size only slightly larger than the outer diameter of the coil spring ends 99. However, a more effective attachment location according to this embodiment comprises a triangular hole 96 having one corner 100 thereof facing outwardly toward the string 58. The end 99 of the spring 92 engages the outer facing corner of the triangular hole 96 providing accurate lateral alignment of the string 58 so that it remains stationary relative to the frame member 95. The triangular hole 96, however, allows for rapid removal of the spring end 99 from the frame member 95 since the wider opening toward its rear 102, facilitates removal of the end 99 without substantial interference from the sides of the hole 96.

In this embodiment, unlike the embodiment of FIGS. 3 and 4 in which the leaf spring 74 is riveted (by rivet 61) to the outer frame member 62, the coil spring 92 is detachably secured between the central frame member 95 and the opposite end of the string 58. As noted above, however, the tensioning structure can be attached at either of opposing attachment locations. Furthermore, it should be noted that while the string 58 shown in FIGS. 3–6 is supported essentially perpendicularly to the line of gravity 63, it is equally possible to tension a string in a parallel (vertical) or diagonal direction relative to gravity.

Figure 7:
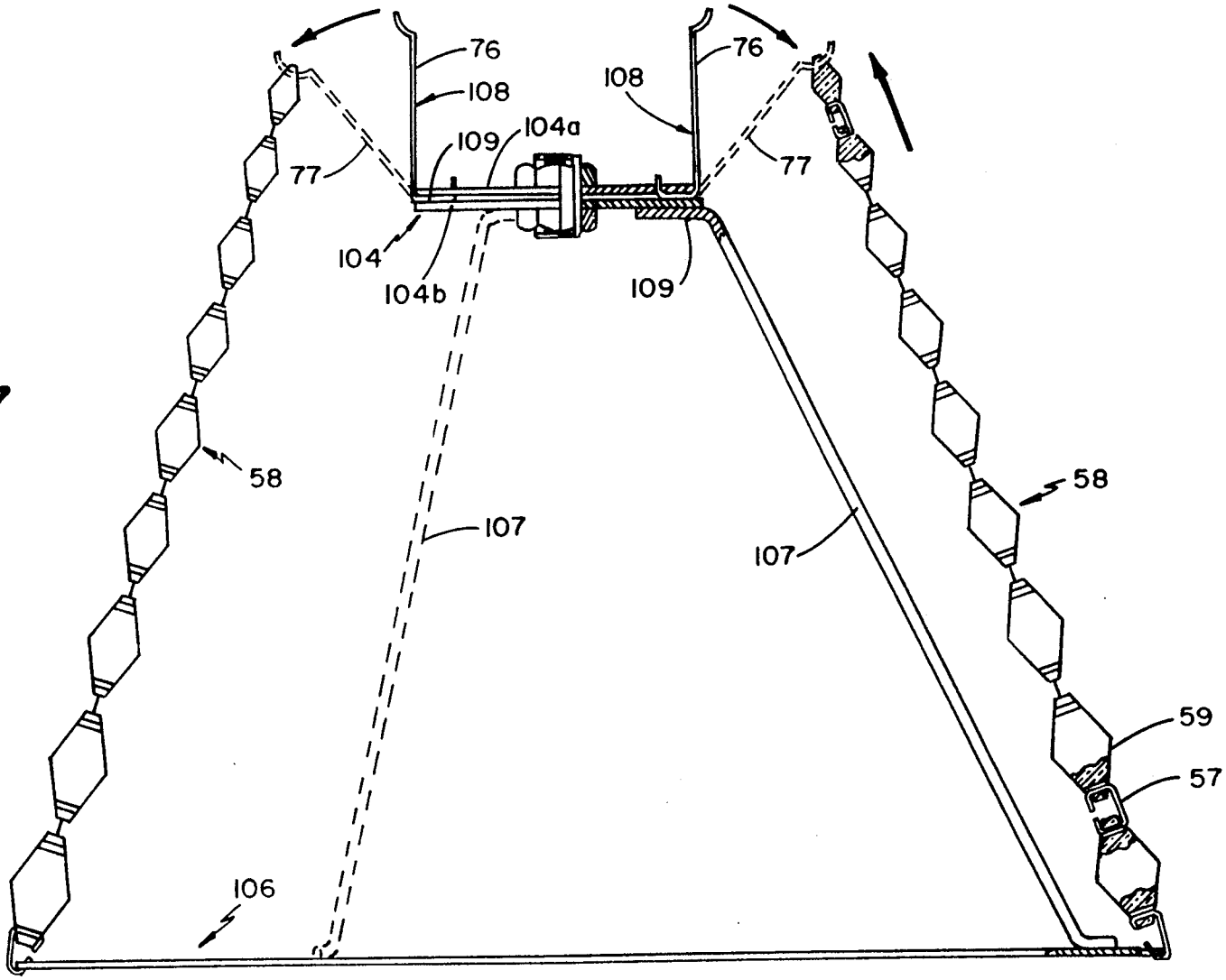
FIG. 7 is a partial cross-sectional side view of a chandelier frame having a few exemplary ornament strings that define a substantially frustoconical shape using a tensioning spring structure according to one embodiment of this invention.

A wide variety of configurations are possible according to the string tensioning structures of this invention. FIG. 7 details a leaf spring tensioning structure embodiment used to form a somewhat frustoconical string configuration between a smaller diameter upper and a larger diameter lower pair of concentric frame members 104 and 106. The frame members 104 and 106 are held in a fixed relationship relative to each other by frame braces 107. The upper frame member 104 carries the leaf springs 108 in this embodiment. The mounted position 77 is shown in phantom. The springs 108 are fixed to the upper frame member 104 by sandwiching their ends 109 between two upper frame member plates **104*a* and 104*b***.

Figure 8:
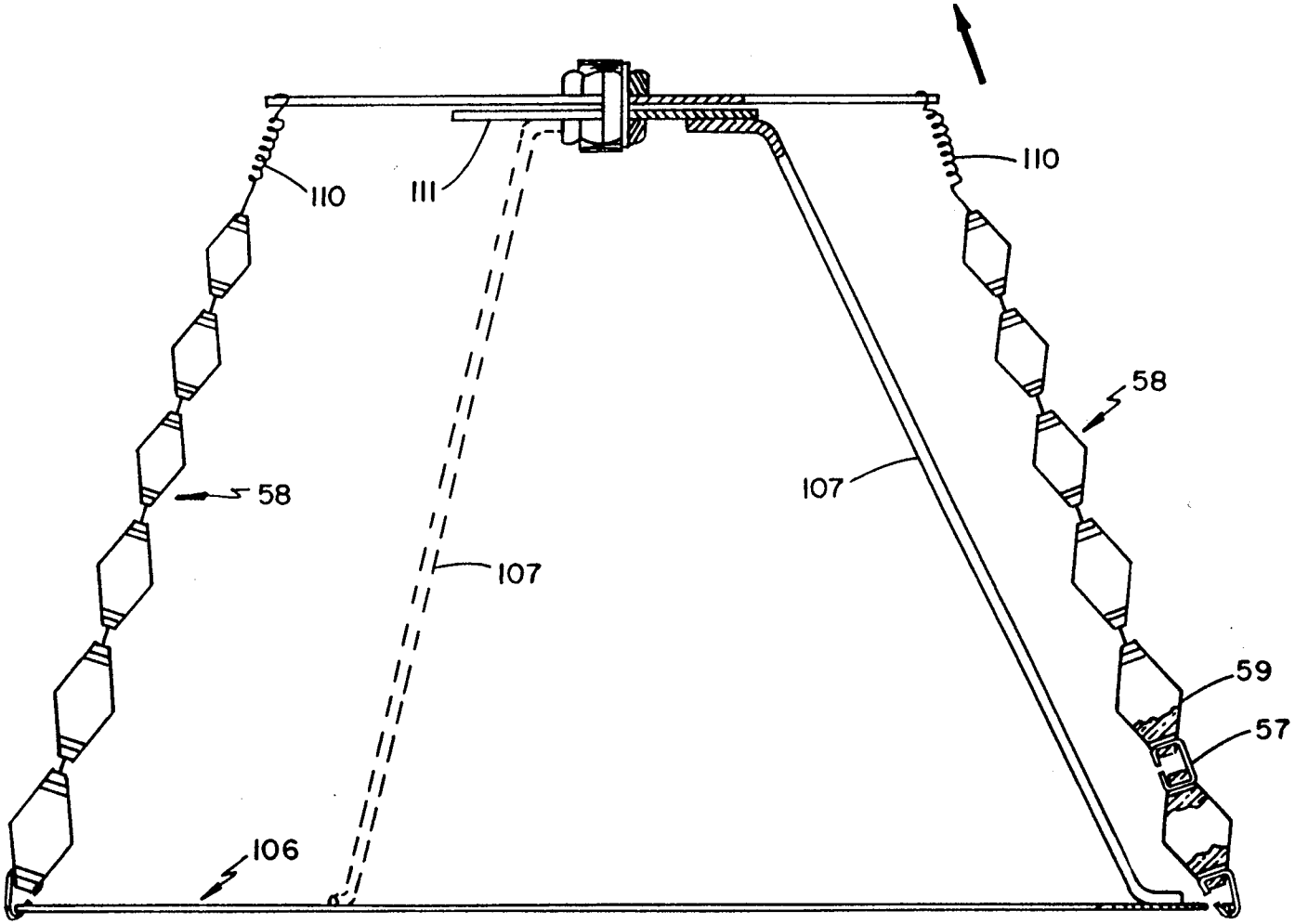
FIG. 8 is a partial cross-sectional side view of a chandelier frame having a few exemplary ornament strings that define a substantially frustoconical shape using a tensioning spring structure according to an alternative embodiment of this invention.

FIG. 8 shows an embodiment substantially similar to that of FIG. 7 utilizing coil springs 110 between the end of each ornament string 58 and upper frame member 111. One advantage of coil springs over leaf springs is that they extend completely linearly and, thus, do not require a lever arm length in order to generate tension. Coil springs can also be attached and detached relatively easily from a frame member. Conversely, a leaf spring must have a sufficient length in order to provide a predetermined tension over a predetermined distance. Hence, a short leaf spring cannot account for reasonably large variations in string length. Furthermore, one end of a leaf spring must be securely fixed to the frame member by, for example, clamping structures or rivets.

As noted above, the tensioning structure should typically provide sufficient tension to draw its string into a substantially straight configuration. Too little tension for a given weight string allows the strings to form into a catenary or arcuate configuration that is unintended. Of course, the tension imparted by the tensioning structure should not be so strong as to break or permanently deform the elements of the string.

While attachment locations and tensioning structures may be positioned and configured to enable easy attachment and detachment of ornament strings, it may be desirable to shorten the distance between attachment locations temporarily in order to facilitate easier attachment of strings to the frame without the need of applying significant tension to springs during the attachment process. Similarly, it can be desirable to lengthen the distance between attachment locations subsequent to ornament attachment in order to increase the tension on the ornament strings. Accordingly, FIGS. 9 and 10 detail examples of adjustable tensioning mechanisms according to this invention.

Figure 9:
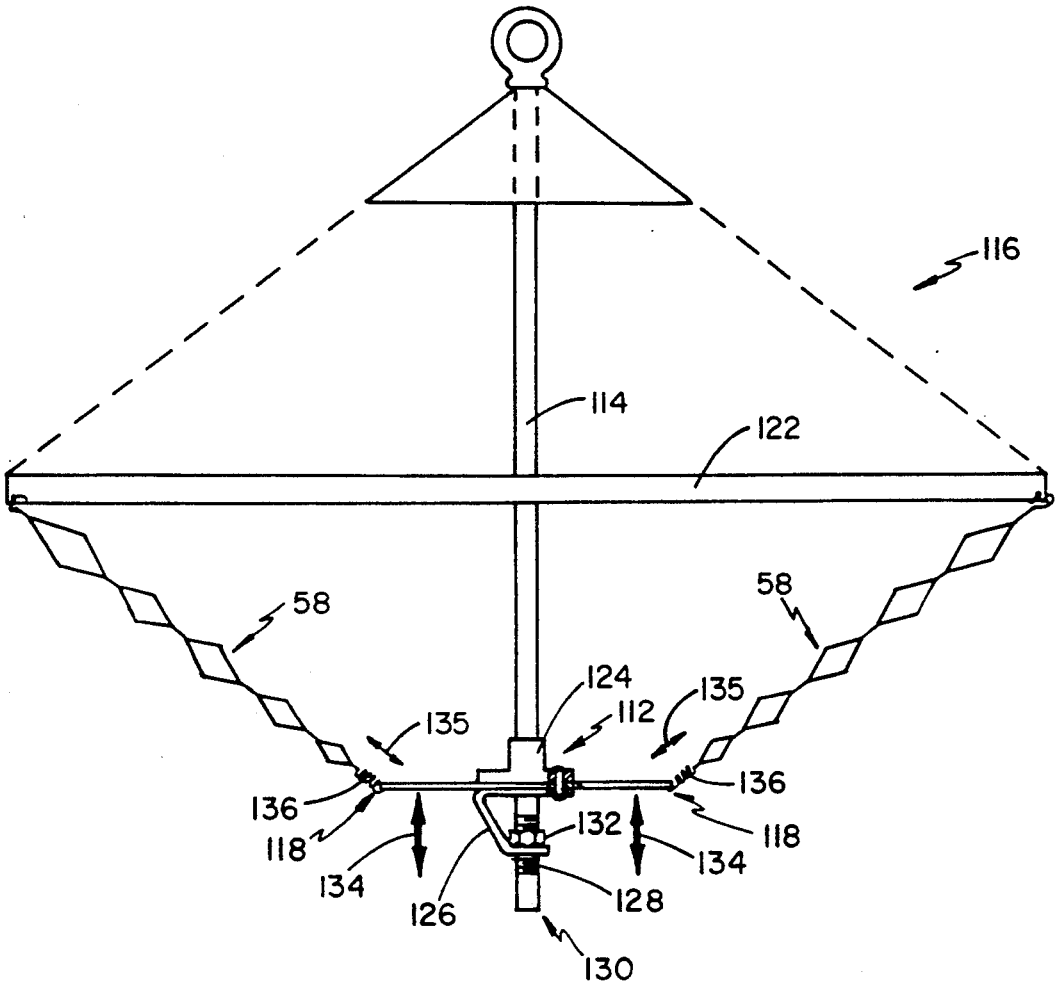
FIG. 9 is a somewhat schematic side view of a chandelier frame having a variably positionable frame member to provide variable tensioning on ornament strings according to one embodiment of this invention.

FIG. 9 shows a movable frame member 112 positioned along a center rod 114 of the chandelier frame 116. The movable frame member 112 includes a plurality of attachment locations 118 for attaching ornament strings 58 that extend outwardly to a larger diameter concentric frame member 122. This configuration forms, generally, a frustoconical shape with ornament strings 58 attached about the entire perimeter of the frame 116.

The movable frame member 112 includes a base 124 that is slidably positioned over the center rod 114. The rod 114 and base 124 can be keyed to each other to prevent rotation of one relative to the other. The movable frame member 112 includes an extension 126 that is remote from the base 124 along the rod 114. The extension 126 is also slidably attached to the rod 114 but passes over a set of threads 128 located on the surface of the rod 114 near its lower end 130. A nut 132 bears upon the extension 126, and as it is turned on the threads 128, it allows the frame member 112 to move upwardly or downwardly on the rod 114 as shown by the arrows 134. Upward movement serves to decrease the distance between attachment locations on the small and large diameter frame members while downward movement serves to increase the distance. This is illustrated by the arrows 135 along the strings 58. Increasing the distance correspondingly increases tension on the ornament strings 58. In this embodiment, coil springs 136 are used as the tensioning structure. However, any suitable type of spring can be utilized according to this embodiment. An adjustable tensioning structure is particularly suitable for coil springs since they tend to be difficult to attach to other structures in a highly tensioned state and, rather, are preferably attached while substantially untensioned.

The springs 136 according to the embodiment of FIG. 9 can be located on either end of an ornament string 58, or, as will be described below, at another location on an ornament string. Similarly, the smaller diameter frame member 112 can be fixed relative to the rod and the larger diameter frame member 122 can be constructed as a movable member. Additionally, for different chandelier configurations, alternative adjustment structures are contemplated. It is primarily important that a frame member carrying, typically, a plurality of ornament strings is movable relative to the rest of the frame in order to increase and decrease the distance (and, hence tension) between attachment locations. For example, a frame member can be movable radially relative to a center shaft rather than axially as in FIG. 9. Radial movement would still serve to increase the distance between attachment locations.

Figure 10:
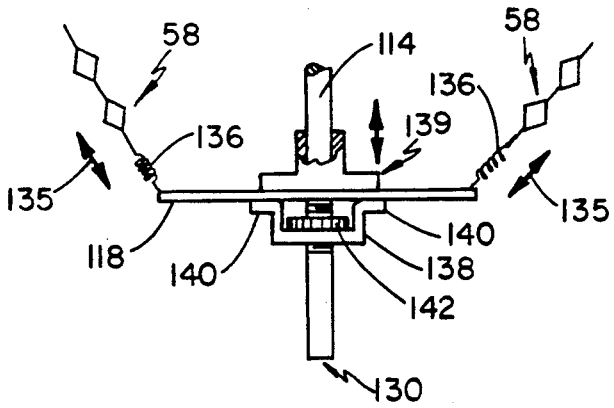
FIG. 10 is a somewhat schematic partial side view of a chandelier frame having a variably positionable frame member according to an alternative embodiment of this invention.

FIG. 10 shows another adjustable tensioning embodiment. In this instance, a frame member support structure 138 is attached to the smaller diameter lower frame member 139 at least two positions 140. The support structure 138 encloses a knurled nut 142 that allows for rapid and convenient raising and lowering of the frame member relative to the rod.

An advantage of the axially movable frame member as shown in the embodiments of FIGS. 9 and 10 is that all strings in a grouping (such as a frustoconical grouping) between frame members can be tensioned simultaneously. However, as noted above, it is also possible to provide variable tensioning to individual strings or to smaller groupings of strings. Individual strings can be tensioned using turn screws, turnbuckles or lockable sliding frame members. Sliding frame members can include ratchets that allow the frame members to be moved incrementally relative to the rest of the frame.

FIGS. 11–16 illustrate examples of chandelier shapes formed from groupings of tensioned ornament strings. Tensioning enables the strings 143 to take on a substantially straight appearance. Thus, regular geometrical shapes such as conical, frustoconical, cylindrical and disk-like shapes are possible according to this invention.

Figure 11:
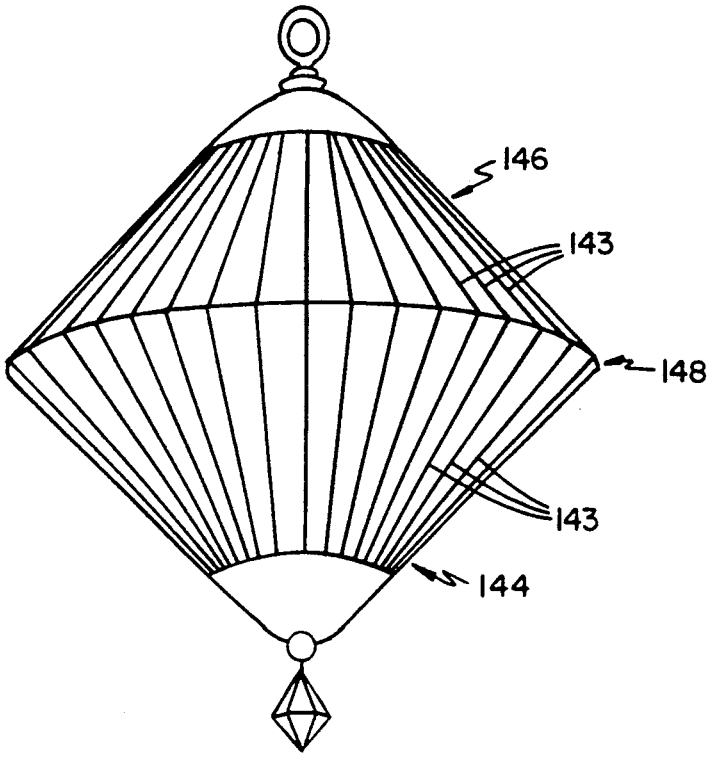
FIGS. 11–16 are schematic perspective views of chandeliers having a variety of geometrical surface shapes defined by ornament strings tensioned into substantially straight configurations according to this invention.

FIG. 11 shows a chandelier defining a pair of frustoconical surfaces 144 and 146 joined at a center 148 and tapering to a smaller diameter in each of opposite directions from the center 148.

Figure 12:
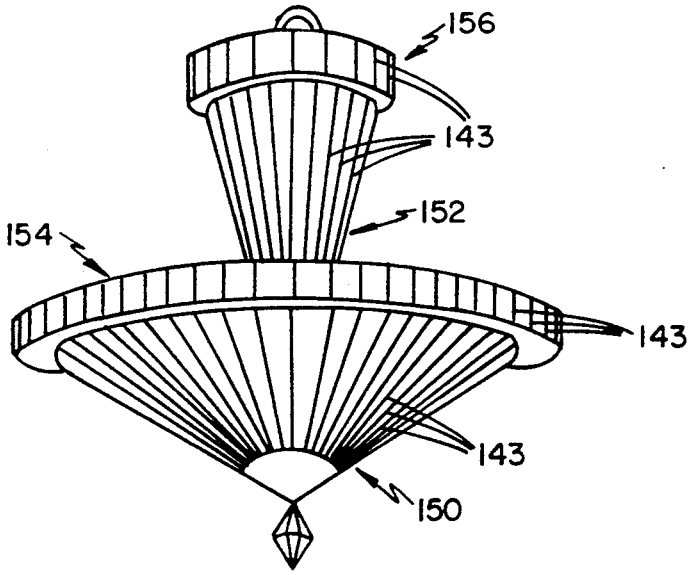

FIG. 12, in contrast, shows a pair of concentric frustoconical surfaces 150 and 152 positioned atop one another with each surface 150 and 152 tapering in the same direction. The lower frustoconical surface 150 has a wider base 154 than the base 156 of the larger frustoconical surface 152.

Figure 13:
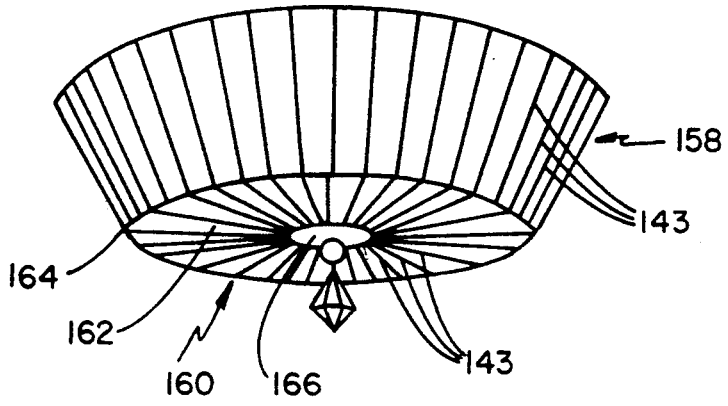

FIG. 13 shows a chandelier defining a single frustoconical surface 158 with a wide lower base 160 having a plurality of strings 143 defining a disk-like surface 162 on the face of the lower base 160. The strings defining the disk 162 extend between the outer edge 164 of the cone and a center frame member 166.

Figure 14:
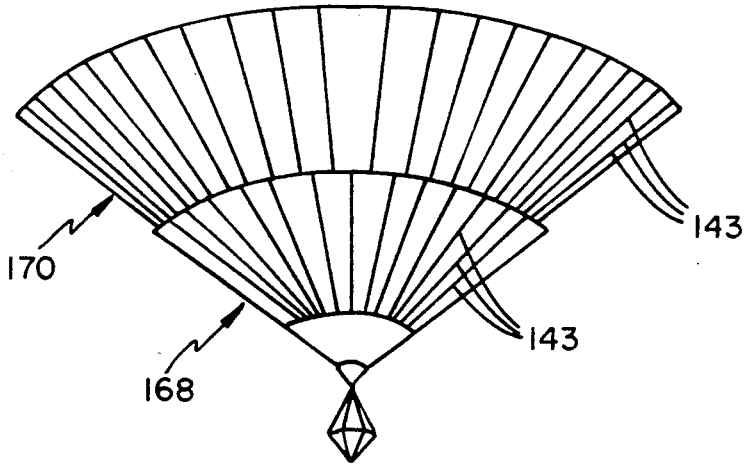

FIG. 14 shows a chandelier defining a pair of concentric frustoconical surfaces 168 and 170 that taper in the same direction to form a tiered structure.

Figure 15:
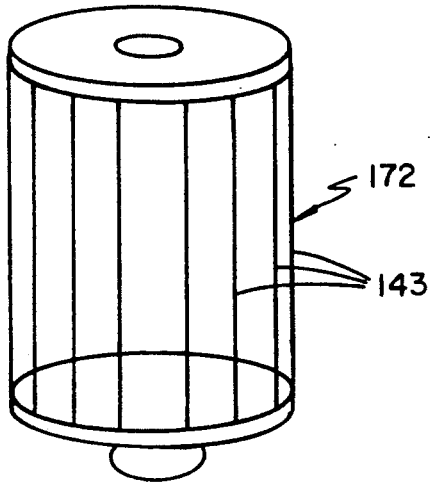

FIG. 15 shows a chandelier having a side wall 172 formed of ornament strings 143 and defining a cylinder. While it is possible for untensioned strings to maintain such a substantially straight configuration, slight variations in string length, absent tensioning, result in slack in some strings of the cylinder. Such slack facilitates misalignment of the strings and drooping that detracts from the desired optical effect.

Figure 16:
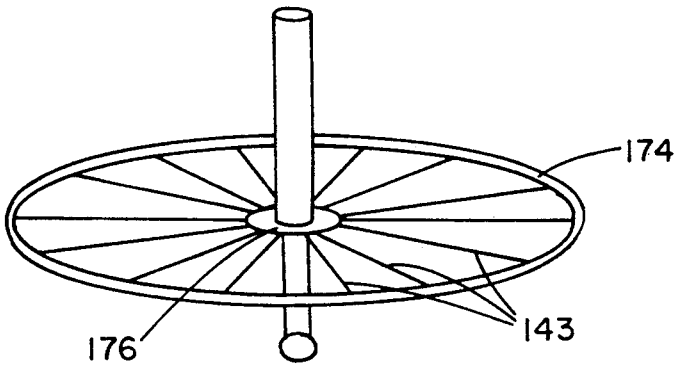

FIG. 16 shows a chandelier in which strings 143 extend between an outer frame member 174 and an inner concentric frame member 176 and defining a basic disk. Tensioning maintains the strings 143 in a substantially straight planar configuration.

Figure 17:
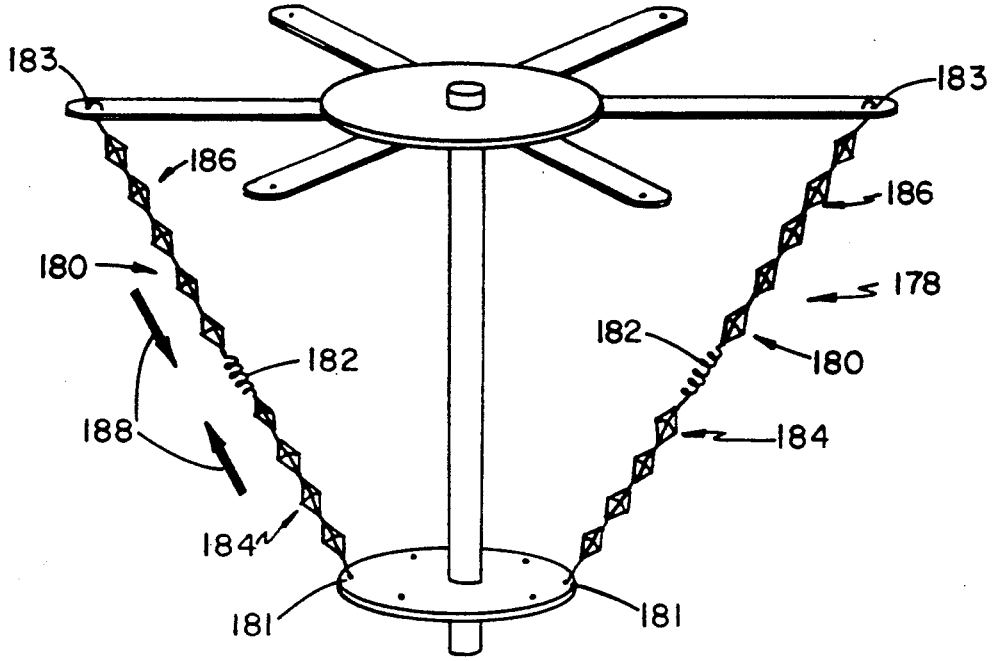
FIG. 17 is a perspective view of a chandelier frame having a tensioning spring structure positioned remote from frame member attachment locations.

As noted above, ornament strings according to this invention can be tensioned by providing tensioning structures at positions along the string span remote from the attachment locations. FIG. 17 shows a chandelier frame 178 having ornament strings 180 with coil spring tensioning structures 182 positioned in the approximate middle of each string 180. In this embodiment, the middle is considered a point between frame member attachment locations. However, each partial section 184 and 186 of the string can alternatively be considered as a discrete string. The opposing frame member attachment locations 181 and 183 are spaced at a distance that is greater than the length of the string 180 including the attached coil spring 182 in a resting state. As such, the coil spring 182 must be stretched in order to attach the opposing ends of the string 180 to respective frame member attachment locations. Stretching of the spring imparts tension on the two sections 184 and 186 of the string 180 as shown by the arrows 188.

Positioning of the tensioning structure along a midsection length of the string can be desirable when the frame member attachment locations are clearly visible while the center portion of the string is not a noticeable. Similarly, for certain maintenance applications, attachment and detachment of the strings may be easier if the tensioning structure is placed remote from the attachment locations.

Figure 18:
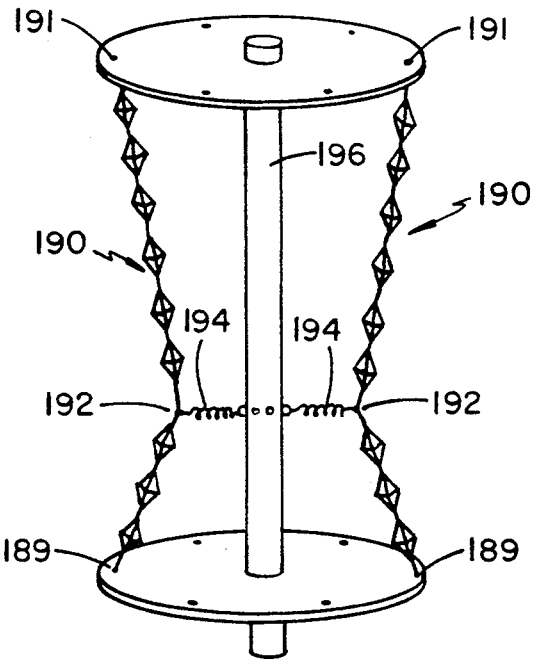
FIG. 18 is a perspective view of a chandelier frame having tensioning spring structures positioned to tension two sections of a string inwardly toward a center axis of the frame.

FIG. 18 shows an alternate string tensioning embodiment according to this invention. The strings 190 appear continuous from one frame member attachment location 189 to the opposing attachment location 191. The strings 190 are connected at their approximate midsections 192 to coil spring tensioning structures 194 that pull the strings 190 radially inwardly toward the frame's central rod 196. These strings 190 are slack between the opposing attachment locations in an untensioned state so that when the coil springs are tensioned as shown, they define a substantially "hourglass" shape in the strings.

A larger diameter frame member around the midsection of the frame also can be used, with the slackened strings attached to the larger diameter frame member using tensioning structures to form a pair of opposing frustoconical surfaces. This design would define a shape similar to the embodiment of FIG. 11.

A variety of tensioning structures are contemplated according to this invention. Coil springs and leaf springs have been specifically described above. In providing a tensioning structure it is important primarily that it flexibly resists linear extension and stores linear deformation generated by extension as tensioning force. Typically, a tensioning structure must be formed from spring material. A spring material has the property of deforming elastically and storing energy within a predetermined, relatively large, range of extension.

Figure 19:
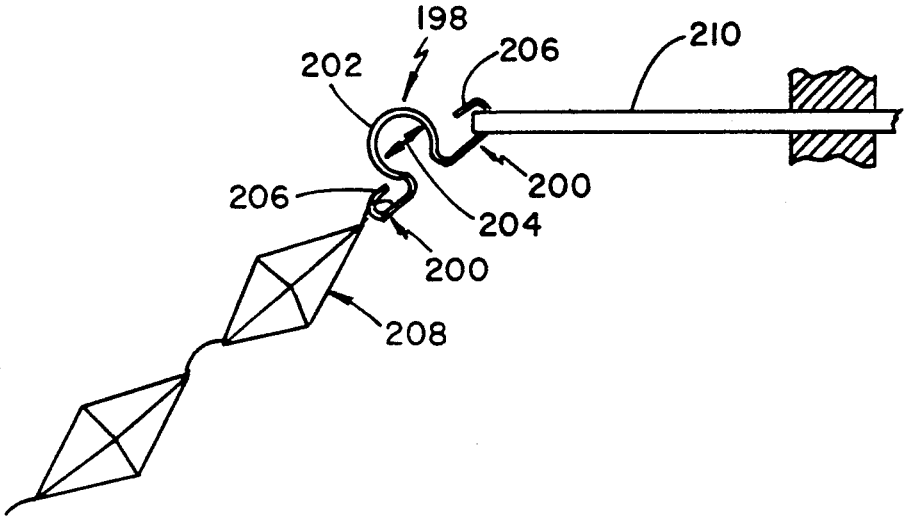
FIG. 19 is a partial side view of a chandelier frame showing a tensioning spring structure according to an alternative embodiment of this invention.

FIG. 19 depicts an alternative embodiment of a tensioning structure according to this invention. The tensioning structure comprises a spring 198 in the shape of a "Omega". The spring lies largely within a plane and is deformed by pulling the two bases 200 of the Omega loop 202 away from each other as shown by the arrow 204. The Omega can be formed from spring steel wire or a similar material having a predetermined diameter and an Omega loop 202 sized sufficiently to allow elastic extension within a predetermined range and at a predetermined tension level. The bases 200 in this embodiment include hooks 206 for engaging an end of the string 208 and the frame member 210.

Figure 20:
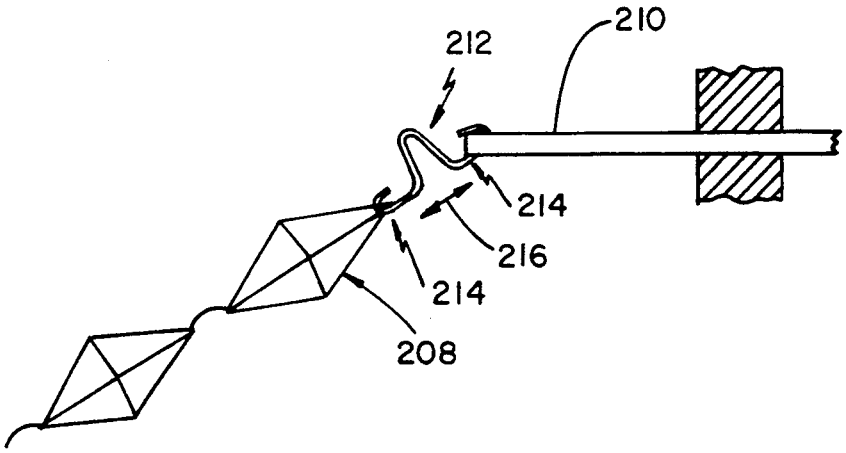
FIG. 20 is a partial side view of a chandelier frame showing a tensioning spring structure according to yet another embodiment of this invention.

FIG. 20 shows a somewhat similar design for a planar spring structure. This spring structure 212 is formed somewhat in the shape of a "U" or "V". The legs 214 of the "U" extend from each other in tension as shown by the arrow 216.

Each of the embodiments of FIGS. 19 and 20 can be termed as "substantially U shaped loops" of spring material. While the Omega bends in at its base, it still forms a somewhat "U shape". Accordingly, a "substantially U shaped loop" according to this invention shall mean any shape of spring material lying substantially in a plane and having a loop of spring material with an open end and, typically, a pair of attachment hooks at each edge of the open end. The spring deforms so that the attachment hooks move away from each other and the opening at the open end becomes wider.

It will be understood by those skilled in the art that various changes and modifications to the embodiments shown in the drawings and described above may be made within the scope of the invention. Accordingly, the foregoing should be taken by way of example and not otherwise limit the scope of the invention. Rather, these and all other equivalents are intended to be encompassed by the following claims.

What is claimed is:

1. A chandelier comprising:

a frame having first and second attachment locations;

a plurality of strings of ornaments extending between the first and second attachment locations and tensioned in a predetermined pattern by a plurality of springs attached to the strings.

2. A chandelier as set forth in claim 1 wherein at least one of the springs is attached between one of the first and second attachment locations and an end of one of the strings of ornaments.

3. A chandelier as set forth in claim 1 wherein the spring comprises a tension coil spring.

4. A chandelier as set forth in claim 1 wherein the spring comprises a substantially U-shaped loop of spring material.

5. A chandelier as set forth in claim 1 wherein the spring comprises a leaf spring.

6. A chandelier as set forth in any one of claims 1–4 wherein the predetermined pattern defines a frustoconical shape.

7. A chandelier as set forth in any one of claims 1–5 wherein the predetermined pattern defines a shape that is at least a portion of a cylinder.

8. A chandelier as set forth in any one of claims 1–5 wherein the predetermined pattern defines a planar shape.

9. A chandelier as set forth in claim 8 wherein in an installed position the predetermined pattern defines a planar shape that is oriented substantially perpendicular to the direction of gravity.

10. A chandelier as set forth in claim 8 wherein in an installed position the predetermined pattern defines a substantially disk like shape.

11. A chandelier as set forth in any one of claims 1–5 wherein the frame includes a mounting plate, the mounting plate including one of the first and second attachment locations positioned thereon.

12. A chandelier as set forth in claim 11 wherein the frame includes means for lengthening the distance between the first and second attachment locations whereby tension upon the strings of ornaments is increased.

13. A chandelier as set forth in claim 12 wherein the means for lengthening includes a means for selectively positioning the mounting plate at a plurality of locations on the frame.

14. A chandelier as set forth in claim 13 wherein the frame includes a plurality of attachment locations constructed and arranged so that the plurality of strings of ornaments may be positioned between the mounting plate and frame members remote from the mounting plate.

15. A chandelier comprising:

a frame having a mounting member;

a plurality of strings of ornaments each having a spring connected thereto and each of the strings of ornaments being connected to the mounting member and to a point on the frame remote from the mounting member; and means for extending the spacing of the mounting member from the remote points whereby each of the strings of ornaments experiences predetermined tension.

16. A chandelier as set forth in claim 15 wherein the means for extending comprises an adjustment screw for engaging the mounting plate.

17. A chandelier as set forth in claim 16 wherein the strings of ornaments define a substantially frustoconical shape.

* * * * *